US006010546A

United States Patent [19]

Hirano et al.

[11] Patent Number: 6,010,546

[45] Date of Patent: Jan. 4, 2000

[54] BLASTING MEDIUM AND BLASTING METHOD EMPLOYING SUCH MEDIUM

[75] Inventors: Hachiro Hirano, Ichihara; Teiji Kawada, Tokyo; Shintaro Kikuchi; Hidetomi Haga, both of Kitakyushu, all of Japan

[73] Assignee: Asahi Glass Company, Ltd., Tokyo, Japan

[21] Appl. No.: 08/971,689

[22] Filed: Nov. 17, 1997

[51] Int. Cl.[7] ..... C09C 1/68; B24C 1/00; B24C 11/00

[52] U.S. Cl. ..... 51/307; 51/309; 451/38; 451/39; 451/40

[58] Field of Search ..... 51/307, 309; 134/28, 134/22.16, 22.13, 22.17; 451/38, 39, 40

[56] References Cited

U.S. PATENT DOCUMENTS

| | | | |
|---|---|---|---|
| 5,230,185 | 7/1993 | Kirschner et al. | 451/99 |
| 5,308,403 | 5/1994 | Yam et al. | 51/307 |
| 5,308,404 | 5/1994 | Yam et al. | 51/307 |
| 5,316,587 | 5/1994 | Yam et al. | 51/307 |
| 5,332,447 | 7/1994 | Winston et al. | 51/308 |
| 5,384,990 | 1/1995 | Spears, Jr. | 451/38 |
| 5,439,493 | 8/1995 | Kirschner | 51/309 |
| 5,509,971 | 4/1996 | Kirschner | 51/309 |
| 5,575,705 | 11/1996 | Yam et al. | 451/39 |
| 5,588,901 | 12/1996 | Rubey, III et al. | 451/39 |
| 5,605,491 | 2/1997 | Yam et al. | 451/39 |
| 5,669,945 | 9/1997 | Yam | 51/309 |
| 5,827,114 | 10/1998 | Yam et al. | 451/40 |

FOREIGN PATENT DOCUMENTS

| | | |
|---|---|---|
| WO90/11163 | 10/1990 | WIPO . |
| WO91/15308 | 10/1991 | WIPO . |

*Primary Examiner*—Michael Marcheschi
*Attorney, Agent, or Firm*—Oblon, Spivak, McClelland, Maier & Neustadt, P.C.

[57] ABSTRACT

A blasting medium composed of a granulated product which comprises a water-soluble inorganic salt as the main component and which has a weight average grain size of from 1 to 10 mm.

20 Claims, No Drawings

BLASTING MEDIUM AND BLASTING METHOD EMPLOYING SUCH MEDIUM

BACKGROUND OF THE INVENTION

1. Field of the Invention

The present invention relates to a novel blasting medium and a blasting method employing such a medium.

2. Discussion of Background

Heretofore, sand has usually been used as a blasting medium (abrasive material), but the use has been rather limited, since an installation to be used exclusively for recovery of sand is required, and a problem occurs such that sand scatters around the environment, or sand enters into a sliding part of the machine. On the other hand, sodium hydrogencarbonate (sodium bicarbonate) has heretofore been proposed as a water-soluble blasting medium (JP-B-6-69668, JP-B-7-55451, WO91/15308). However, this is directed to use of crystals of sodium bicarbonate, of which the average particle size is at most 0.5 mm, and it is used mainly for removal of coatings from the metal surfaces of aircrafts. It is used merely as a paint remover as a substitute for methylene chloride, from the viewpoint of easiness of waste treatment. Accordingly, if it is used for removal of a wall material such as mortar, for removal of an epoxy resin coating on the interior surface of a pool, for removal of coatings or putty material from vehicles, for cleaning a bogie of a vehicle, or for removal of shells from the bottom of a ship, for which sand blasting has been used, the removing or stripping ability is inadequate, and it takes time for the operation.

SUMMARY OF THE INVENTION

It is an object of the present invention to provide, inexpensively and on an industrial scale, a novel blasting medium which is soluble in water so that waste treatment is easy, and cleaning or removing the blasting medium entered into a clearance of the object to be cleaned, is easy, and which has a sufficiently large removing ability as a substitute for sand blasting, while the degree of damaging a primer coat surface is small, the danger to the worker can be reduced, and which is further effective for cleaning oil and fat.

Another object of the present invention is to provide an efficient blasting method employing such a medium anew.

The present invention has been made to solve the above mentioned problems, and it provides a blasting medium composed of a granulated product which comprises a water-soluble inorganic acid salt as the main component and which has a weight average grain size of from 1 to 10 mm, preferably from 1 to 5.7 mm, more preferably from 1.2 to 4.0 mm. Particularly preferred is a blasting medium prepared by compression molding the above water-soluble inorganic acid salt and then granulating the molded product to the above mentioned average grain size.

The present invention also provides a blasting method, which comprises blasting a surface with a pressurized fluid containing such a blasting medium.

DETAILED DESCRIPTION OF THE PREFERRED EMBODIMENTS

For the blasting medium of the present invention, not only the material constituting it is important, but also it is important that the medium is a granulated product having a predetermined grain size. Further, it is preferably one prepared by a predetermined means. If the above mentioned average grain size is less than 1 mm, the blasting ability tends to be small, and if it exceeds 10 mm, supply of the granulated product by e.g. air transportation during the blasting operation tends to be difficult, or the production cost of a block-form granulated product tends to be high.

In the present invention the blasting medium being a granulated product means that the average hardness (breaking strength) of the blasting medium reaches preferably a level of at least 0.5 kg (as measured by Kiya Type Degital Hardness Meter KHT-20 Model), and it provides excellent properties as a blasting medium, as described hereinafter, in combination with the water solubility and proper flexibility as characteristics of the material of the medium.

The water-soluble inorganic acid salt as the main component of the blasting medium of the present invention is preferably a carbonate, a hydrogencarbonate, a sulfate, a hydrochloride, or a mixture thereof. The cation is preferably an alkali metal such as sodium or pottasium, or ammonium. For example, it is preferably sodium hydrogencarbonate, sodium carbonate, ammonium hydrogencarbonate or sodium sulfate.

Particularly preferred is sodium hydrogencarbonate, since the pH of its aqueous solution is weakly alkaline, and it has no toxicity, so that disposal after use is easy. For example, in a wet blasting operation employing high pressure water, the blasting agent dissolves in water, and its aqueous solution is weakly alkaline and contains no eutrophication substances such as organic substances, heavy metals, nitrogen and phosphorus which give a load to the environment, and thus it can be easily drained.

To the blasting medium of the present invention, other components such as silica and a water repellant may be added or impregnated, as the case requires.

For example, to prevent solidification due to powdering of the molded product, it is advisable to incorporate fumed silica or the like. Further, when it is desired to reduce the dissolving rate in water, it is effective to add a water repellant.

On the other hand, if it is desired to improve the dissolving rate in water, the blasting medium is preferably such that the granulated product contains a dissolution accelerator for the granulated product, and the dissolution accelerator has a higher solubility in water than the water-soluble inorganic acid salt. Such a blasting medium can be prepared by mixing the dissolution accelerator for the granulated product to the water-soluble inorganic acid salt, followed by granulation.

The above effects are obtainable especially when the inorganic acid salt is a hydrogencarbonate of an alkali metal. For example, when the inorganic acid salt is sodium hydrogencarbonate, sodium chloride, sodium acetate or sodium sulfate maybe used preferably as the above dissolution accelerator for the granulated product. The amount of the above component is preferably from 1 to 20 wt %, based on the weight of the hydrogencarbonate.

The material for the above blasting medium is usually available in a powder form having a small particle size. To convert such a powder into a granulated product having the above mentioned average grain size, it is granulated by dry or wet system compression molding, extrusion molding, stirring or rolling. Among them, it is preferred to use dry system compression molding in the present invention. The granulated product of the blasting medium is preferably obtained by molding such a powder into flakes by compression molding by a roller press under a linear load of from 1 to 20 t/cm, and then pulverizing or granulating the flakes to the above mentioned grain size. The grain size of the medium is adjusted preferably by a suitable grain size selector or sieving machine.

As a blasting method by means of the blasting medium of the present invention, a conventional method may be employed. Namely, the fluid containing the above blasting medium preferably in an amount of from 1 to 30 wt %, is blasted against a surface to be treated by blasting, preferably under a pressure of from 1 to 2000 kg/cm$^2$ (1 to 203 MPa). As the above fluid, a gas or a liquid may be used alone, or a mixed fluid of a gas and a liquid may be employed.

When the fluid is a gas such as air, it is preferred to employ a gas containing from 1 to 15 wt % of the blasting medium.

On the other hand, when a liquid such as water is used as the fluid, it is preferred to employ one containing from 1 to 20 wt % of the blasting medium. Further, if the liquid has a temperature of from 40 to 90° C., particularly from 65 to 85° C., the ability for removing coatings, the cleaning ability, the rust-removing ability and the surface roughening ability are excellent.

The blasting medium of the present invention can be used for blasting of various objects and applications. For example, it can be used for cleaning or removing exterior coatings of ships, aircrafts, machines, vehicles, bridges or building structures, for surface roughening of e.g. concrete or artificial stones, for primer coat treatment of a coating (rust-removal), for cleaning wall surfaces of e.g. floors or exterior walls, for removal of oil and fat and for cleaning sewage tanks or waste water pits. Further, since the granulated product is water-soluble, it can be applied for blasting of an object, to which conventional sand blasting can not be applied, for the reason that sand will remain. For example, it can be applied for blasting ships, vehicles, machine apparatus such as engines or plant equipments to remove stains or rusts. It is particularly useful for removing shells attached to e.g. screws of ships.

Now, the present invention will described in detail with reference to Examples. However, it should be understood that the present invention is by no means restricted to such specific Examples.

EXAMPLE 1

300 kg of sodium hydrogencarbonate as a food additive having an average particle size of 91 μm was molded by means of a roller compactor WP model, which is a roll press type compression molding machine manufactured by Turbo Kogyo KK. This machine has a roll outer diameter of 230 mm and roll width of 80 mm and was operated under a linear load of 3.75 t/cm. Then, compression-molded flakes were granulated by a flake breaker which is a granulator with a rotary brade, installed at the outlet of the molding machine and then all passed through a rotary fine granulator with a mesh of 4.75 mm, which is a rotary grain size selector, installed at the down stream. Then, this molded product was subjected to a turbo-screener TS model, which is a rotary sieving machine manufactured by Turbo Kogyo KK to remove grains larger than 4.0 mm and smaller than 1.0 mm.

The granulated product thus obtained had a weight average grain size of 2.08 mm and a weight average hardness of 3.3 kg. Further, the average hardness of 20 granulated grains of from 1.4 to 2.0 mm was 3.7 kg.

Further, the dissolution rate in water of this granulated product was measured as follows. The granulated product of from 1.0 to 4.0 mm was sieved with a sieve of 2 mm to remove grains larger than 2 mm. 25 g of this granulated product was taken and introduced into a 1l beaker made of glass with an inner diameter of 105 mm containing 475 g of water of 25° C., stirred at 500 rpm by a stirrer having a length of 49 mm and a thickness of 8 mm. The dissolution time of the granulated product was determined by visual observation and found to be 10 minutes 51 seconds.

This granulated product was used as a substitute for sand blasting by a high pressure warm water cleaning machine and employed for an operation of removing a mortar exterior wall. Warm water of 75° C. was used as water for the high pressure cleaning machine, and the operation was carried out by pressurizing the warm water to 450 kg/cm$^2$ (45 MPa). The operation speed was 11.6 m$^2$ per hour.

Further, the waste water from the blasting had a pH of 8.10 and was a solution having no trouble for disposal.

EXAMPLE 2

300 kg of sodium hydrogencarbonate as a food additive having an average particle size of 88 μm, was treated in the same manner as in Example 1 to obtain a granulated product.

The granulated product thereby obtained had an average grain size of 1.95 mm and a weight average hardness of 5.3 kg. Further, the hardness of granulated grains of from 1.4 to 2.0 mm was 3.2 kg.

This granulated product was used as a substitute for sand blasting by a high pressure warm water cleaning machine and employed for an operation for removing an epoxy resin coating on an inner wall of a pool. Warm water of 75° C. was used as water for the high pressure cleaning machine, and the operation was carried out by pressurizing the warm water to 450 kg/cm$^2$ (45 MPa). The operation speed was 4 m$^2$ per hour.

Further, the waste water from the blasting had a pH of 8.12 and was a solution having no trouble for disposal.

EXAMPLE 3

Molding was carried out in the same manner as in Example 1 except that 10 wt % of anhydrous sodium acetate having an average particle size of 153 μm was added as a dissolution accelerator to the sodium bicarbonate in Example 1, to obtain a granulated product. The granulated product thereby obtained had a weight average grain size of 2.51 mm and a weight average hardness of 3.4 kg. Further, the dissolution time of 27.8 g of the granulated product having a particle size of from 1 to 2 mm was measured in the same manner as in Example 1 and found to be 2 minutes 41 seconds.

This granulated product was used as a substitute for sand blasting by a high pressure warm water cleaning machine and employed for an operation of removing a mortar exterior wall. Warm water of 75° C. was used as water for the high pressure cleaning machine, and the operation was carried out by pressurizing the warm water to 450 kg/cm$^2$ (45 MPa). The operation speed was 11.2 m$^2$ per hour.

COMPARATIVE EXAMPLE 1

Sodium hydrogencarbonate as a food additive having an average particle size of 286 μm was used as it is without granulation as a substitute for sand blasting by a high pressure warm water cleaning machine and employed for an operation of removing a mortar exterior wall, in the same manner as in Example 1. Warm water of 75° C. was used as water for the high pressure cleaning machine, and the operation was carried out by pressurizing the warm water to 450 kg/cm$^2$ (45 MPa). The operation speed was 8.5 m$^2$ per hour, and thus the operation efficiency was low as compared with Example 1.

COMPARATIVE EXAMPLE 2

Sodium hydrogencarbonate as a food additive having an average particle size of 280 μm was used as it is without granulation in a high pressure cleaning machine and employed for an operation of removing an epoxy coating on an inner wall of a pool, in the same manner as in Example 2. The operation speed was 0.4 $m^2$ per hour, and thus the the operation efficiency was low as compared with Example 2.

The blasting medium of the present invention is water-soluble and thus requires no cumbersome operation such as recovery after its use, as is different from conventional sand (silica sand) and thus can be used at a place where the recovery is difficult or the remaining blasting medium creates a trouble. Further, the blasting ability is comparable to sand blasting, and efficient blasting can be carried out. At the same time, the hardness and the grain size can be adjusted by adjusting the granulation degree or the pressure during the compression molding for a granulated product as the blasting medium. Accordingly, the surface of the object which is subjected to blasting, will not be unduly damaged. Further, the blasting medium of the present invention does not adversely affect the environment.

Further, to use the present invention for a conventional blasting operation, sand may simply be substituted by the granulated product of the present invention, whereby the operation can easily be carried out without substantially changing the conventional blasting operation.

What is claimed is:

1. A blasting medium composed of a granulated product which comprises a water-soluble inorganic acid salt as the main component and which has a weight average grain size of from 1 to 10 mm, wherein said blasting medium consists essentially of grains having a grain size of at least 1 mm.

2. The blasting medium according to claim 1, wherein the granulated product is one prepared by compression-molding a water-soluble inorganic acid salt and then granulating the molded product.

3. The blasting medium according to claim 2, wherein the granulated product is prepared by the compression-molding by a roller press under a linear load of from 1 to 20 t/cm.

4. The blasting medium according to claim 1, wherein the granulated product has an average hardness of at least 0.5 kg.

5. The blasting medium according to claim 1 or claim 2, wherein the water-soluble inorganic acid salt is a hydrogencarbonate of an alkali metal.

6. The blasting medium according to claim 1, wherein the water-soluble inorganic acid salt is sodium hydrogencarbonate.

7. The blasting medium according to claim 5, wherein the granulated product contains a dissolution accelerator for the granulated product, and the dissolution accelerator has a higher solubility in water than the water-soluble inorganic acid salt.

8. The blasting medium according to claim 7, wherein the dissolution accelerator for the granulated product is present in an amount of from 1 to 20 wt %, based on the weight of the hydrogencarbonate of an alkali metal.

9. A blasting method which comprises blasting a surface with a pressurized fluid containing a blasting medium consisting of a granulated product which comprises a water-soluble inorganic salt as the main component and which has a weight average particle size of from 1 to 10 mm, wherein said blasting medium consists essentially of grains having a grain size of at least 1 mm.

10. The blasting method according to claim 9, wherein the fluid is warm water of from 40 to 90° C.

11. The blasting method according to claim 9, wherein the blasting with the fluid containing the blasting medium is carried out under a pressure of from 1 to 2000 $kg/cm^2$.

12. The blasting method according to claim 9, wherein the blasting is carried out with a fluid containing from 1 to 30 wt % of the blasting medium.

13. The blasting method according to claim 9, wherein the blasting is carried out with a liquid containing from 1 to 20 wt % of the blasting medium.

14. The blasting method according to claim 9, wherein the blasting is carried out with a gas containing from 1 to 15 wt % of the blasting medium.

15. The blasting method according to claim 9, wherein a surface of an exterior coating is subjected to the blasting with the blasting medium to remove a coating or a putty material.

16. The blasting method according to claim 9, wherein a concrete, artificial stone or plastic surface is subjected to the blasting with the blasting medium for surface roughening.

17. The blasting method according to claim 9, wherein a floor surface or a wall surface is subjected to the blasting with the blasting medium for removal of oil and fat or for stain removal.

18. The blasting method according to claim 9, wherein a primer coat of a coating is subjected to the blasting with the blasting medium for rust removal.

19. The blasting method according to claim 9, wherein a ship, vehicle, machinery or plant equipment is subjected to the blasting with the blasting medium for stain removal or for rust removal.

20. The blasting medium according to claim 1, wherein said weight average grain size is from 1.95 to 10 mm.

* * * * *